US010517785B2

(12) United States Patent
Petterson et al.

(10) Patent No.: US 10,517,785 B2
(45) Date of Patent: Dec. 31, 2019

(54) MEDICAL LIFTING DEVICE

(71) Applicant: Strong Arm Technologies, Inc., Rochester, NY (US)

(72) Inventors: Sean Petterson, Mount Sinai, NY (US); Justin Hillery, Rochester, NY (US); Cole Dubord, Rochester, NY (US); Jordan Darling, Rochester, NY (US)

(73) Assignee: StrongArm Technologies Inc., Brooklyn, NY (US)

( * ) Notice: Subject to any disclaimer, the term of this patent is extended or adjusted under 35 U.S.C. 154(b) by 287 days.

(21) Appl. No.: 15/127,148

(22) PCT Filed: Mar. 17, 2015

(86) PCT No.: PCT/US2015/020959

§ 371 (c)(1),
(2) Date: Sep. 19, 2016

(87) PCT Pub. No.: WO2015/142845

PCT Pub. Date: Sep. 24, 2015

(65) Prior Publication Data

US 2017/0181910 A1 Jun. 29, 2017

Related U.S. Application Data

(60) Provisional application No. 61/954,146, filed on Mar. 17, 2014.

(51) Int. Cl.
*A61G 7/10* (2006.01)
*A61G 7/14* (2006.01)

(52) U.S. Cl.
CPC ..... *A61G 7/1023* (2013.01); *A61G 7/1015* (2013.01); *A61G 7/1038* (2013.01); *A61G 7/1051* (2013.01)

(58) Field of Classification Search
CPC ..... A61G 7/10; A61G 7/1013; A61G 7/1023; A61G 7/1051

(Continued)

(56) References Cited

U.S. PATENT DOCUMENTS 2,350,573 A * 6/1944 Smith, Jr. et al. ..... A61G 1/01 5/627
2,489,828 A * 11/1949 Springer ..... A61G 1/01 5/628

(Continued)

FOREIGN PATENT DOCUMENTS

EP 1092410 4/2001
GB 1132572 11/1968

(Continued)

OTHER PUBLICATIONS

International Search Report and Written Opinion for International Application No. PCT/US2015/020959, dated Mar. 17, 2015, 9 pages.

(Continued)

*Primary Examiner* — Robert G Santos
(74) *Attorney, Agent, or Firm* — Greenberg Traurig, LLP

(57) ABSTRACT

Medical lifting devices and methods are disclosed. A medical lifting device includes a brace and at least one strap. The brace is adapted to be positioned against the back of a patient. The brace has a pair of opposed lateral edges. The at least one strap extends from each lateral edge of the brace. The at least one strap has a length sufficient to enable a user of the device to grasp each strap while the user is standing with the user's torso in an upright position and the patient is in a seated position. A method of lifting a patient with the brace includes positioning the brace against the back of a patient, grasping each strap while standing in an upright (Continued)

position and while the patient is in a seated position, and pulling on each strap to lift the patient to a standing position.

22 Claims, 9 Drawing Sheets

(58) Field of Classification Search
USPC ..... 5/81.1 T, 89.1, 81.1 R
See application file for complete search history.

(56) References Cited

U.S. PATENT DOCUMENTS 3,158,875 A * 12/1964 Fletcher ..... A61G 1/01 5/628
4,211,218 A * 7/1980 Kendrick ..... A61F 5/05883 128/870
4,742,588 A * 5/1988 James ..... A61G 7/10 5/83.1
4,922,562 A * 5/1990 Allred ..... A61G 1/013 128/870
4,979,520 A * 12/1990 Boone, Jr. ..... A61G 1/01 128/870
5,396,670 A * 3/1995 Firebaugh ..... A61G 7/1017 294/140
5,530,975 A * 7/1996 Firebaugh ..... A61G 7/1017 5/81.1 T
5,701,619 A * 12/1997 Ullman ..... A61G 1/01 5/625
5,711,044 A * 1/1998 Newman ..... A61G 7/1023 5/81.1 T
6,289,534 B1 * 9/2001 Hakamiun ..... A61G 7/1017 5/83.1
6,311,346 B1 * 11/2001 Goldman ..... A61F 5/37 128/876
6,668,397 B2 * 12/2003 Olenick ..... A47C 17/64 296/190.02
6,671,899 B1 * 1/2004 Oja ..... A61G 7/1023 5/81.1 T
7,578,012 B2 * 8/2009 Palay ..... A61G 3/02 5/81.1 R
7,627,912 B1 12/2009 McKinney
7,708,019 B2 * 5/2010 Kendrick ..... A61F 5/05883 128/846
8,800,076 B2 * 8/2014 Ophaug ..... A61G 7/1023 2/338
2003/0140416 A1 * 7/2003 Olenick ..... A47C 17/64 5/118
2004/0025250 A1 2/2004 Bezalel
2006/0213007 A1 * 9/2006 Palay ..... A61G 3/02 5/81.1 R
2007/0278263 A1 12/2007 Zak
2007/0287943 A1 * 12/2007 Kendrick ..... A61F 5/05883 602/19
2009/0276955 A1 * 11/2009 Palay ..... A61G 3/02 5/87.1
2012/0011649 A1 * 1/2012 Ophaug ..... A61G 7/1023 5/81.1 T
2012/0240332 A1 9/2012 Palay
2017/0181910 A1 * 6/2017 Petterson ..... A61G 7/1015
2018/0360682 A1 * 12/2018 Choudhury ..... A61G 7/1023

FOREIGN PATENT DOCUMENTS

GB 2213734 A * 8/1989 ..... A61G 7/1023
WO 2013155461 10/2013

OTHER PUBLICATIONS

International Preliminary Report on Patentability for International Application No. PCT/US2015/020959, dated Sep. 20, 2016, 6 pages.

* cited by examiner

MEDICAL LIFTING DEVICE

CROSS-REFERENCE TO RELATED APPLICATIONS

The present application claims priority to U.S. patent application Ser. No. 61/954,146, entitled "MEDICAL LIFTING DEVICE," filed Mar. 17, 2014, the contents of which are incorporated herein by reference in their entirety.

FIELD OF THE INVENTION

The invention relates generally to the field of lifting patients, and more particularly, to devices and methods for lifting patients to a standing position.

BACKGROUND OF THE INVENTION

In healthcare settings, it is sometimes necessary for healthcare workers such as physicians or nurses to assist patients in rising from a seating or supine position to a standing position. Conventionally, various lifting apparatus such as gait belts have been developed for assisting healthcare workers in these "patient transfers." However, these existing apparatus lack a focus on patient mental comfort and security. Moreover, in recent years, physical injuries, and especially back injuries, have increased among healthcare workers as a result of these patient transfers. Accordingly, improved devices are desired that enhance patient comfort and security and/or enable healthcare workers to perform patient transfers while minimizing the potential for injury during lifting.

SUMMARY OF THE INVENTION

Aspects of the present invention are directed to medical lifting devices and methods.

In accordance with one aspect of the present invention, a medical lifting device is disclosed. The medical lifting device includes a brace and at least one strap. The brace is adapted to be positioned against the back of a patient. The brace has a pair of opposed lateral edges. The at least one strap extends from each lateral edge of the brace. The at least one strap has a length sufficient to enable a user of the device to grasp each strap while the user is standing with the user's torso in an upright position and the patient is in a seated position.

In accordance with another aspect of the present invention, a method of lifting a patient by a user is disclosed. The method includes the steps of positioning a brace against the back of a patient, the brace having a pair of opposed lateral edges and a strap extending from each lateral edge of the brace, grasping each strap while standing in an upright position and while the patient is in a seated position, and pulling on each strap to lift the patient to a standing position.

BRIEF DESCRIPTION OF THE DRAWINGS

The invention is best understood from the following detailed description when read in connection with the accompanying drawings, with like elements having the same reference numerals. When a plurality of similar elements are present, a single reference numeral may be assigned to the plurality of similar elements with a small letter designation referring to specific elements. When referring to the elements collectively or to a non-specific one or more of the elements, the small letter designation may be dropped.

According to common practice, the various features of the drawings are not drawn to scale unless otherwise indicated. To the contrary, the dimensions of the various features may be enlarged or reduced for clarity. Included in the drawings are the following figures.

DETAILED DESCRIPTION OF THE INVENTION

Figure 1:
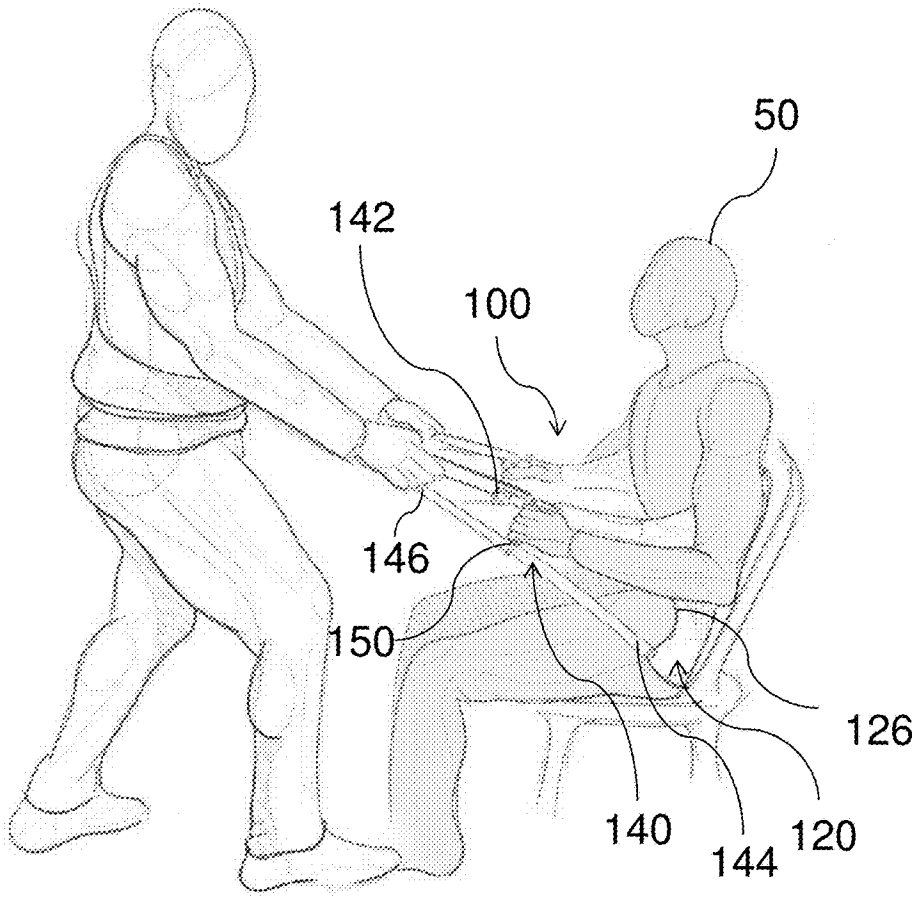
FIG. 1 is a diagram illustrating an exemplary medical lifting device in accordance with aspects of the present invention.

The embodiments of the invention described herein relate to lifting devices usable by healthcare workers for lifting patients to a standing position. While the invention is described herein with respect to medical settings, it will be understood that the lifting devices described herein are usable in any situation requiring the lifting of a person to a standing position.

The exemplary medical lifting devices disclosed herein are operable to simplify or ease the process of lifting a patient. These devices may be particularly suitable for allowing healthcare workers to remain in a standing or upright position while lifting the patient. This can reduce the likelihood or severity of injury to the healthcare worker during the lift. Other advantages of the disclosed lifting devices will be apparent to one of ordinary skill in the art from the description herein.

For example, the disclosed devices can be used to enable a more ergonomic feel for healthcare workers performing a tradition "hug lift" of a patient, i.e., a lift in which the healthcare worker hugs the seated patient and then lifts the patient to a standing position under their own strength. Unlike during a hug lift, use of the present invention enables healthcare workers to maintain eye contact during the lift, which allows the patient a feeling of comfort and trust that is important during patient movement. The disclosed devices also reduce the possibility of distraction of patient or worker by keeping both parties focused on the lifting device. Still further, the disclosed devices provide increased spacing between parties not present in traditional hug lifts, thereby enabling easier verbal communication during the lift.

The disclosed devices and methods provide a number of advantages over conventional lifting mechanisms. In particular, use of the disclosed devices decreases compressive loading of the spine for healthcare workers with respect to traditional hug lifts. Such loading may be decreased by at least 80%, thereby substantially reducing risk of back pain or injury. Additionally, the disclosed embodiments may provide a substantial (near 100%) increase in the amount of back and/or torso strength that can be employed by the user during the lifting process (with respect to a traditional hug lift).

Referring now to the drawings, FIGS. 1-6 illustrate an exemplary medical lifting device 100 in accordance with aspects of the present invention. Medical lifting device 100 may be used by a healthcare worker to assist in lifting a patient to a standing position. As a general overview, medical lifting device 100 includes a brace 120 and straps 140. Additional details of medical lifting device 100 are described herein.

Figure 2A:
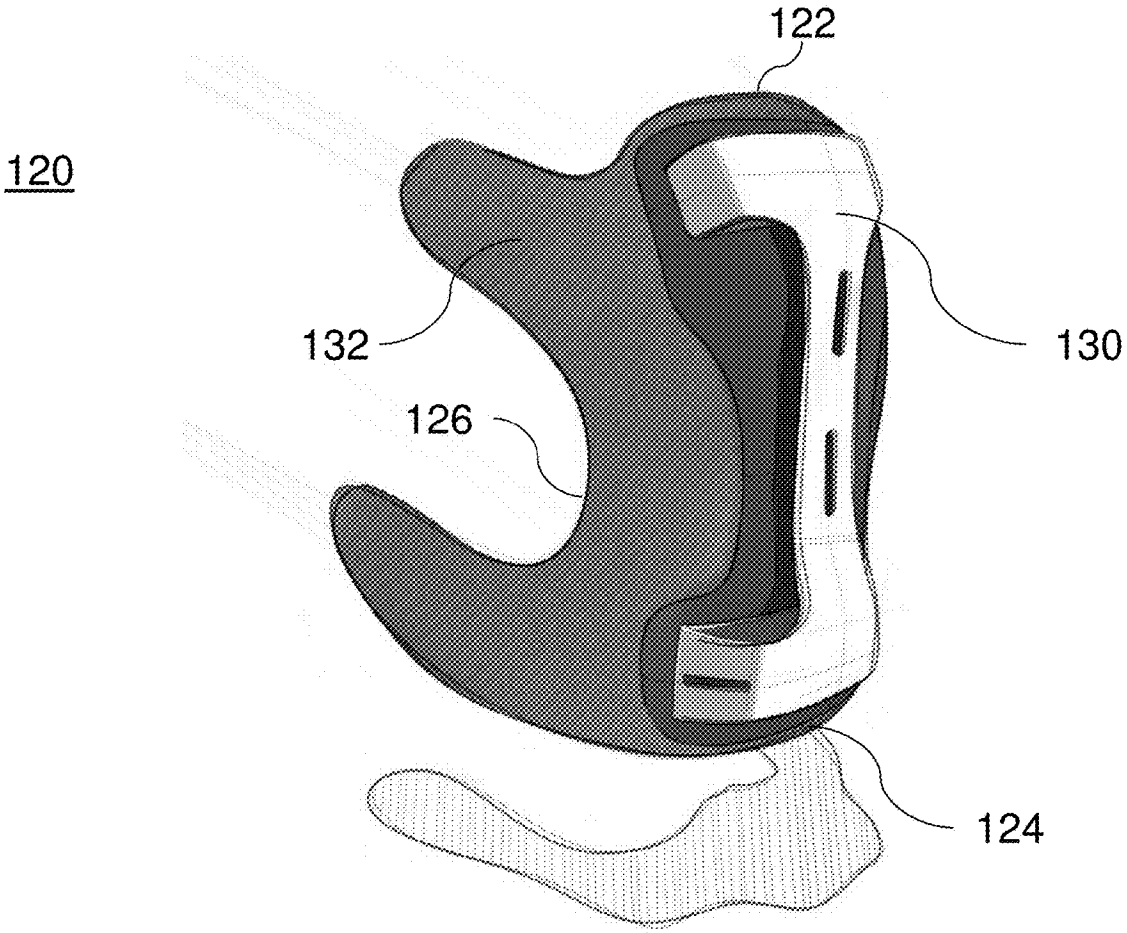
FIGS. 2A-2C are diagrams illustrating exemplary braces of the medical lifting device illustrated in FIG. 1.

Brace 120 is adapted to be positioned against the back of a patient. Brace 120 includes a top edge 122, a bottom edge 124, and a pair of opposed lateral edges 126. As shown in FIG. 1, brace 120 is desirably contoured and shaped such that it can be positioned comfortably against the lower back of patient 50. Brace 120 may be shaped such that it provides support to the optimal region of the lower back of patient 50 during lifting. In an exemplary embodiment, when brace 120 is positioned against the back of patient 50, the top edge 122 of brace 120 extends across a lower thoracic region of the patient's back, and the bottom edge 124 of brace 120 extends across a lower lumbar region of the patient's back. Additionally, lateral edges 126 of brace 120 may be substantially straight, or may have extending portions along the tops and bottoms thereof, as shown in FIGS. 2A-2B.

Brace 120 is formed from materials that provide support to the patient while maintaining the patient's comfort during the lifting process. In an exemplary embodiment, brace 120 includes a core 130 and a padding layer 132, as shown in FIG. 2A. Core 130 is formed from a rigid, inflexible material in order to rigidly support the back of patient 50. Core 130 extends substantially from the top edge 122 of brace 120 to bottom edge 124 of brace 120. While core 130 is shown having an I-shape in FIG. 2A, it is not so limited. For example, in an alternative embodiment, core 130 may have a wishbone shape, as shown in FIG. 2C. In this embodiment, the single end of wishbone core 130 is positioned at the top of brace 120, and the prongs of the wishbone core 130 are positioned at the base of brace 120, to provide stability to the patient's spine during the lift. Suitable materials for use in forming core 130 include, for example, plastics such as high-density polyethylene (HDPE).

Padding layer 132 is positioned between core 130 and the back of patient 50, and is formed from a soft material to enhance the comfort of patient 50. Suitable is materials for use in forming padding layer 132 include, for example, cloths formed from natural or synthetic fibers (such as cotton or nylon). Padding layer 132 may further include one or more cushioning layers 134, as shown in FIG. 2B. Suitable materials for use in forming cushioning layers 134 include, for example, conventional foams. Molded memory foams may be particularly desirable for use as cushioning layers 134.

Figure 2B:
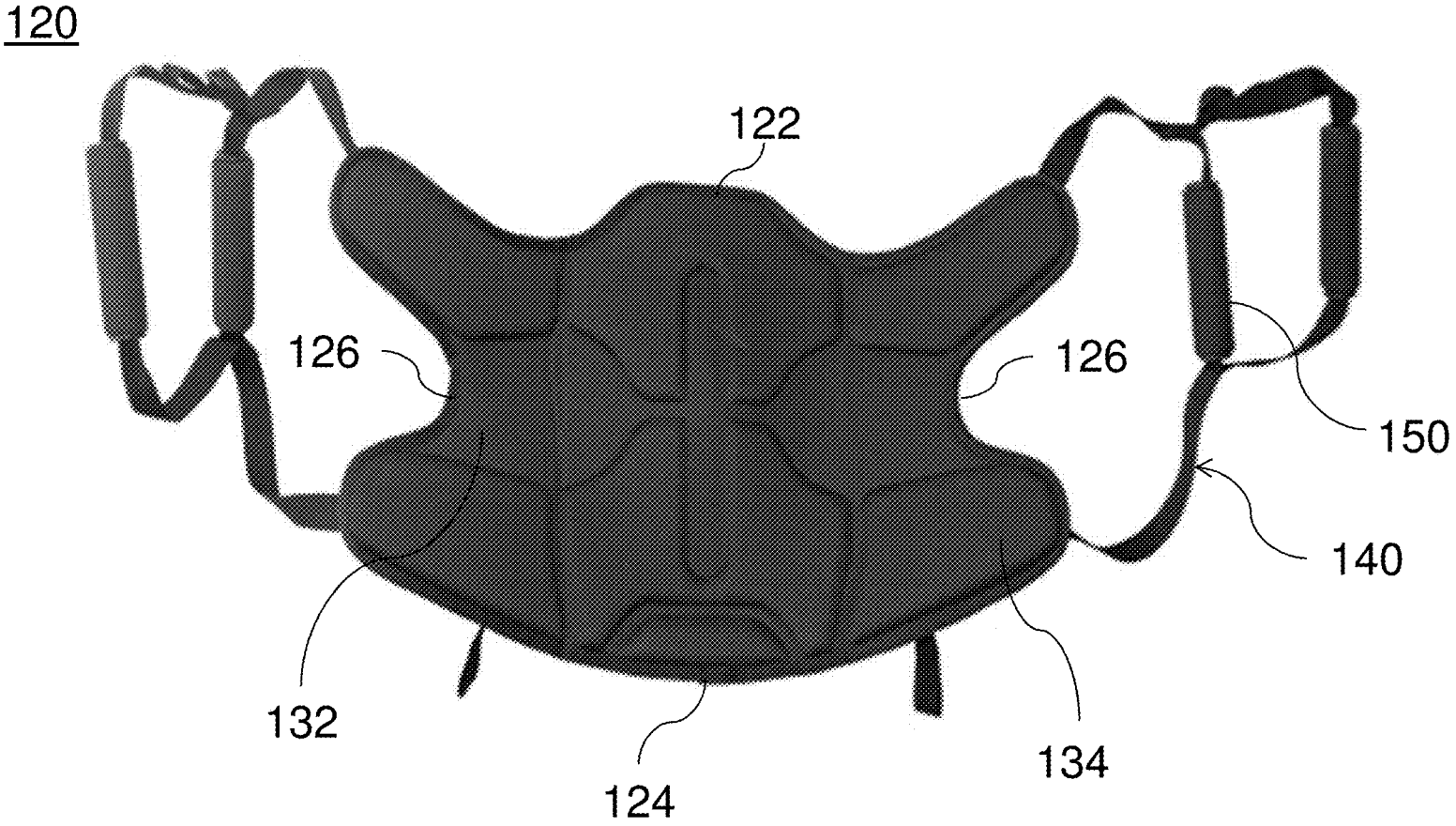
Figure 2C:
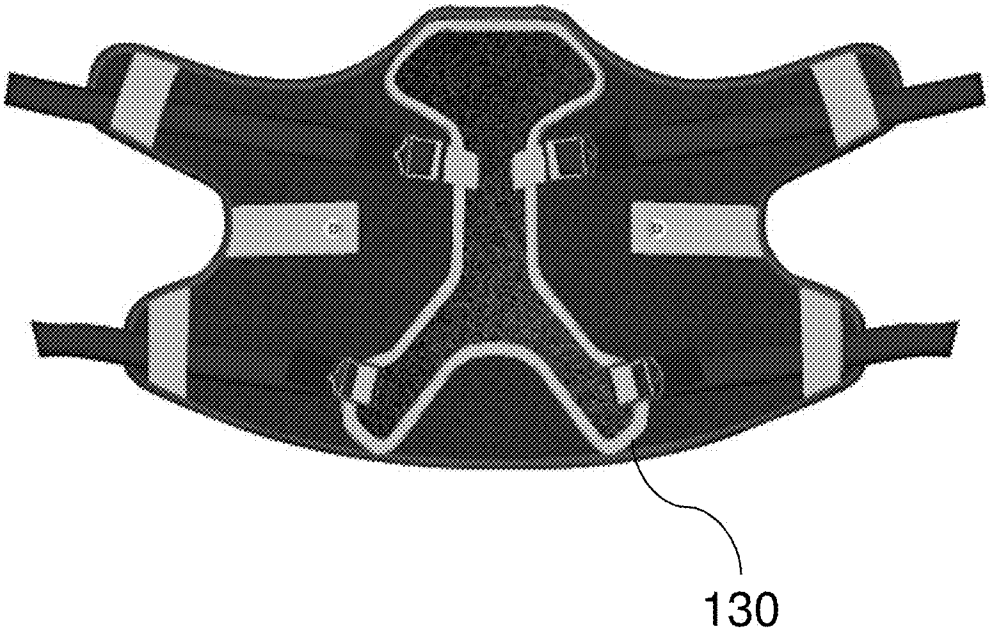

As shown in FIG. 2B, gaps or channels may be formed between cushioning layers 134. These gaps or channels desirably allow air to circulate between brace 120 and patient 50, keeping the patient cool and comfortable during the lifting process.

Straps 140 extend from either side of brace 120. As shown in FIG. 1, straps 140 extend from each lateral edge 126 of brace 120. Straps 140 may desirably extend outward from brace 120 in the regions of the top and bottom edges 122 and 124 of brace 120. In other words, a first portion 142 of each strap 140 desirably extends from an area adjacent the lower thoracic region of the patient's back, and a second portion 144 of each strap 140 desirably extends from an area adjacent the lower lumbar region of the patient's back, as shown in FIG. 1.

Straps 140 have a length sufficient to enable a user of device 100 to grasp each strap 140 while the user is standing with the user's torso in an upright position and the patient is in a seated position. As shown in FIG. 1, the user is able to grasp straps 140 without having the bend over patient 50. Enabling the user to grasp straps 140 while standing in an upright position places the user in a healthier position for assisting with the lifting of the patient, and thereby reducing the likelihood or severity of back injury to the user. In an exemplary embodiment, each strap 140 has a length of at least 17 to 29 inches from the lateral edge 126 of brace 120 to a distal portion 146 of the strap (i.e., the portion of the strap furthest from brace 120).

Straps 140 are formed from a durable, flexible material. Suitable materials for use in forming straps 140 include, for example, nylon, polypropylene, cotton webbing, and/or elastic webbing.

The description and illustration of the number, size, and attachments of straps 140, e.g., in FIGS. 1-2B, is merely for exemplification, and is not intended to be limiting. In particular, additional straps 140 or alternative attachment points for straps 140 may be used without departing from the scope of the present invention. Additionally, device 100 is not limited to the above-described components, but may include alternative or additional components, as would be understood by one of ordinary skill in the art from the description herein.

Figures 3A, 3B:
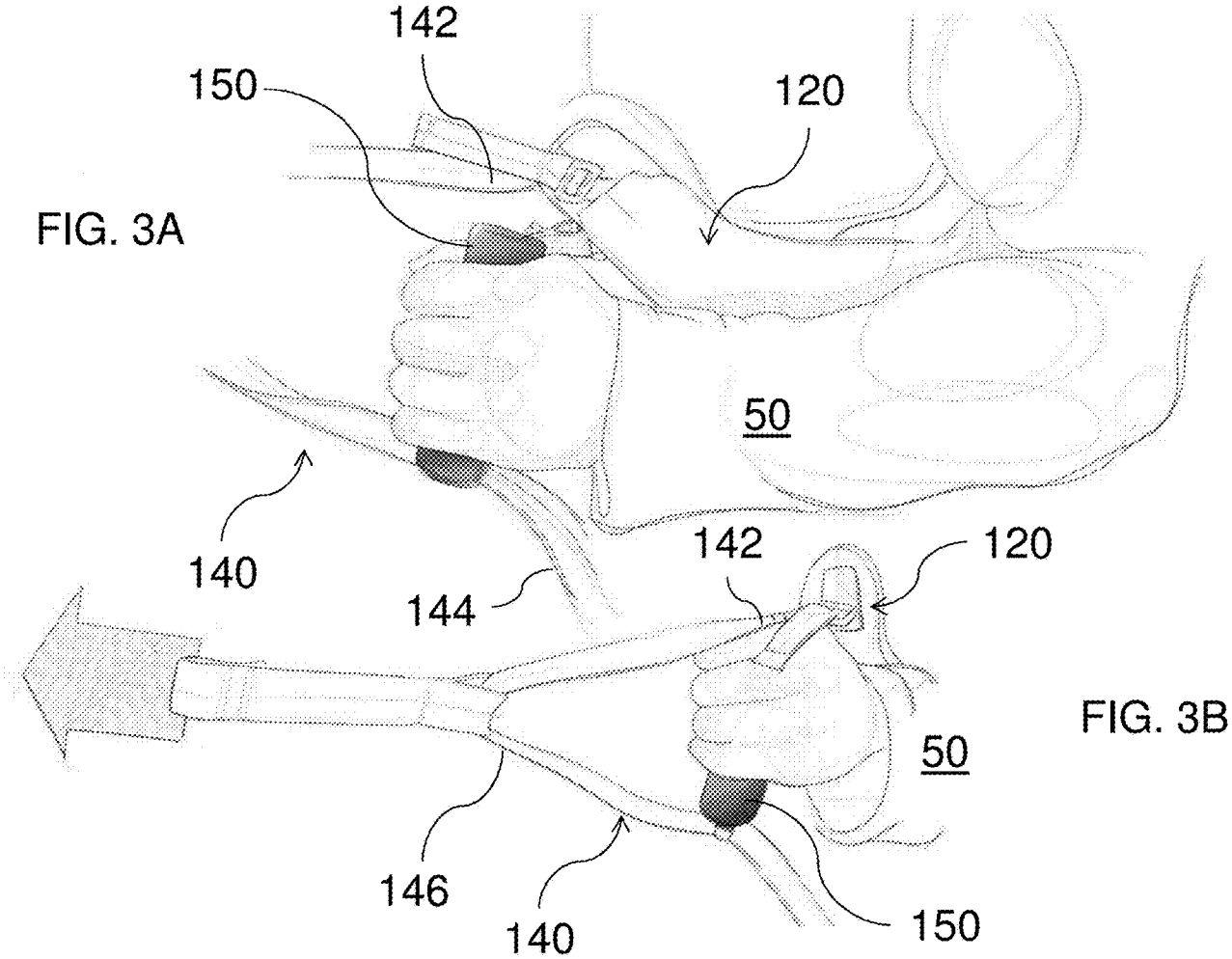
FIGS. 3A-3B are diagrams illustrating exemplary straps of the medical lifting device illustrated in FIG. 1.

Device 100 may further include a pair of handle portions 150. Handle portions 150 desirably provide the patient with a location to place their hands during the lifting process, and may provide patients with enhanced comfort, security, and the feeling that they are assisting with the lifting process. In an exemplary embodiment, each strap 140 includes a respective handle portion 150 coupled thereto, as shown in FIGS. 3A-3B. Handle portions 150 are positioned such that they can be grasped by patient 50 during lifting. To promote grasping of each handle portion 150 by the patient, handle portions 150 extend outwardly from straps 140 at an angle relative to a direction along the length of strap 140. In other words, while straps 140 extend away from the front of patient 50, handle portions 150 desirably extend parallel to the front of patient 50, or orthogonal to the direction of extension of straps 140, as shown in FIGS. 1 and 3A.

While handles 150 are shown as approximately cylindrical in FIG. 2B, it will be understood that the invention is not so limited. Handles 150 may be contoured to provide a comfortable and strong grip for both the patient and the user.

Moreover, handle portions 150 desirably provide enhanced safety for users of device 100. Handle portions 150 are positioned to provide a place for the patient to grab should the patient make a reactionary grab during the lifting process. The patient will grab handle portion 150 instead of the user (e.g., nurse), which in turn creates a safer lifting environment by minimizing the chance that the patient will pull on the user or cause the user to fall. Because the patient and user handles 150 are attached to each other by way of straps 140, the user may still receive tactile feedback from the patient during the lifting process. This tactile feedback (e.g., in the form of pulls or tugs) allows the nurse to react to patient movements during the lift, thereby assisting the user in providing a sense of control and stability to the patient.

In an exemplary embodiment, each handle portion 150 is attached at its upper end to the first portion 142 of strap 140, and is attached at is lower end to the second portion 144 of strap 140. Alternatively, one or both ends of handle portions 150 may be attached directly to the lateral edges 126 of brace 120. As shown in FIGS. 3A-3B, the upper end of each handle portion 150 is attached directly to a projection on lateral edge 126.

In another exemplary embodiment, the position of each handle portion 150 is adjustable along the length of strap 140. It may be desirable to adjust the position of handle portions 150 to accommodate patients having different arm sizes. Thus, handle portion 150 may be movably attached to first strap portion 142 or second strap portion 144, e.g., via one or more slides, loops, or clasps. Suitable structures for adjustably attaching handle portions 150 to straps 140 will be known to one of ordinary skill in the art from the description herein.

Handle portions 150 may be formed of any suitable material, and in some embodiments will be of material more rigid than the material of straps 140. Suitable materials for use in forming handle portions 150 may be natural or synthetic, and include, for example, any suitable plastics such as high-density polyethylene (HDPE) or acrylonitrile butadiene styrene (ABS).

Figure 4:
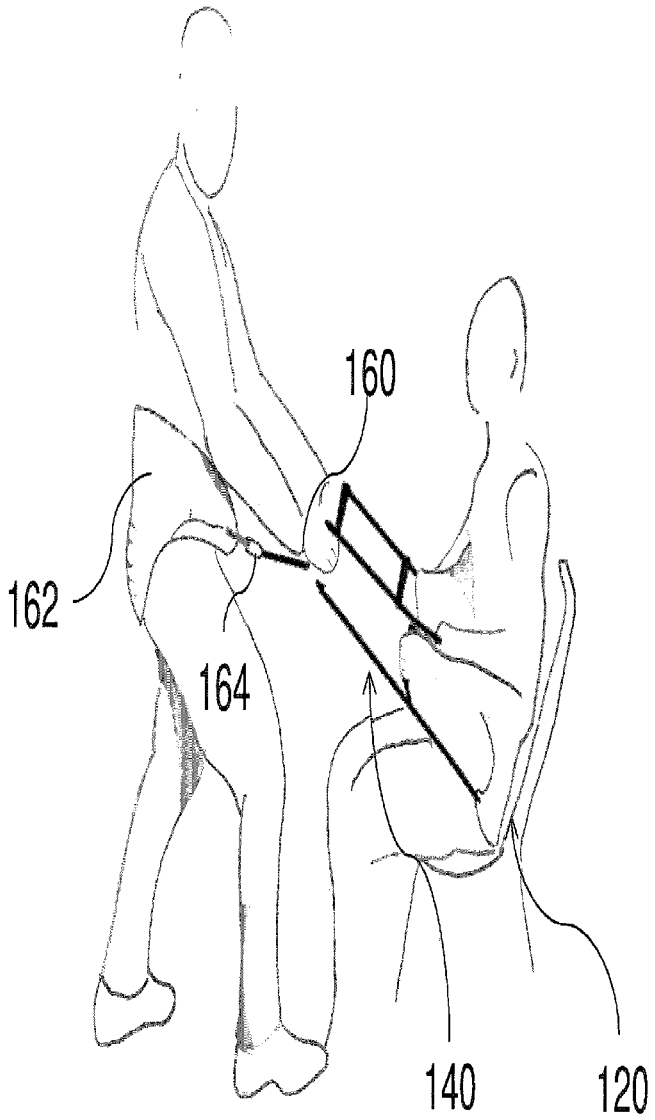
FIG. 4 is a diagram illustrating an exemplary attachment mechanism of the medical lifting device illustrated in FIG. 1.

Device 100 may further include one or more attachment mechanisms 160. While the user may choose simply to grasp straps 140, attachment mechanisms 160 desirably provide a secure attachment between the user and the patient during the lifting process. In an exemplary embodiment, each strap 140 includes a respective attachment mechanism 160 configured to be coupled to the user, as shown in FIG. 4. Attachment mechanism 160 bear at least a portion of the weight of patient 50 when coupled to the user during the lifting process.

In an exemplary embodiment, each attachment mechanism 160 is configured to be attached to a belt 162 worn by the user. In this embodiment, attachment mechanisms 160 on device 100 may comprise one or more rings or loops positioned on the distal portion 146 of straps 140. These attachment mechanisms 160 are configured to mate with a corresponding attachment mechanism 164 on belt 162.

Figure 5:
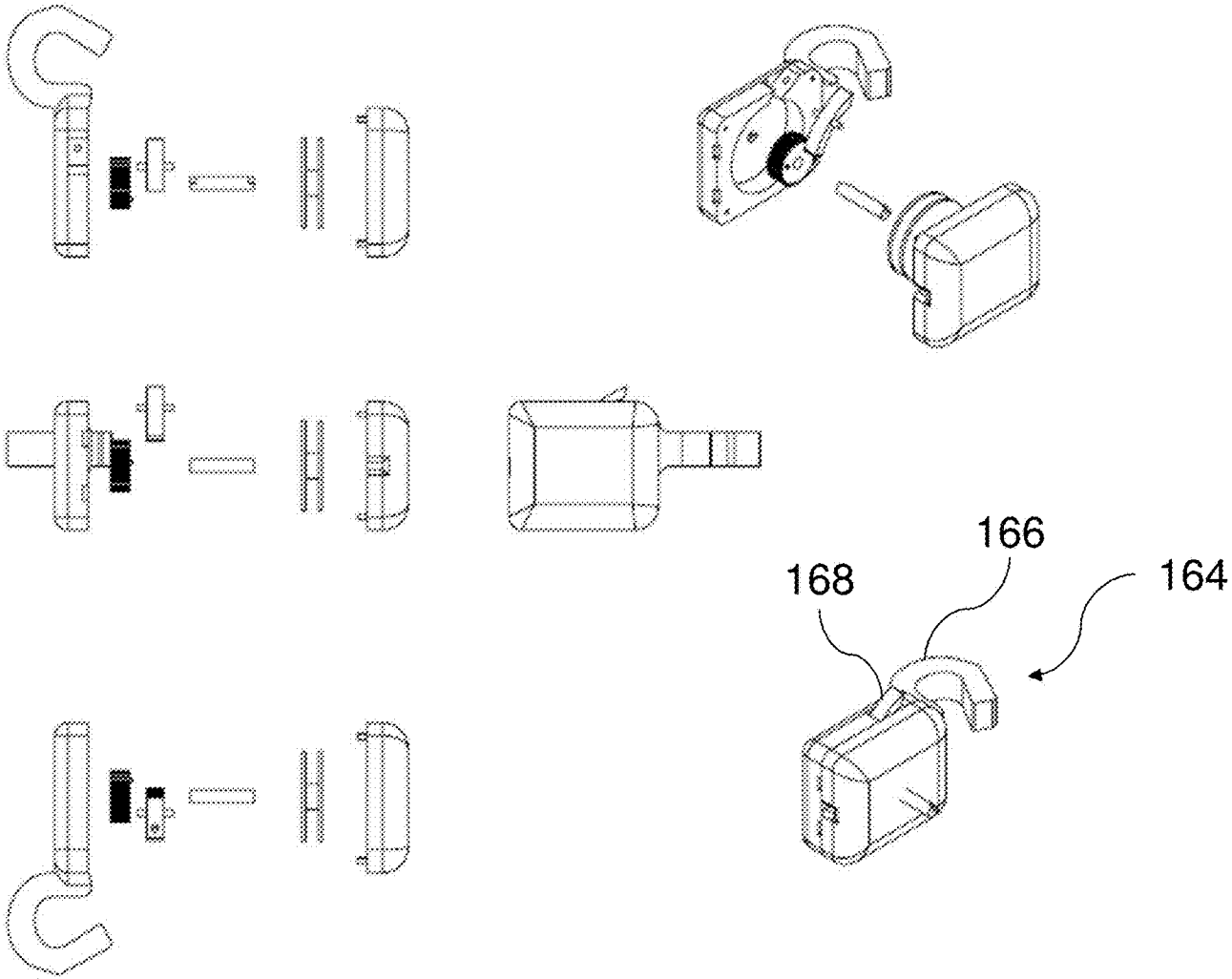
FIG. 5 is a diagram illustrating an exemplary release mechanism of the medical lifting device illustrated in FIG. 1.

An exemplary attachment mechanism 164 for attachment to the belt of the user 162 is shown in FIG. 5. In an exemplary embodiment, attachment mechanism 164 comprises a hook 166 for coupling with the attachment mechanism 160 on device 100. The hook 166 is attached to a tether which is spooled within attachment mechanism 164. The length of the tether is desirably adjusted by the user prior to lifting of the patient, in order to allow the desired distance and stance of the user during lifting. Attachment mechanism may include a ratcheting element for adjusting and then fixing the desired length of the tether.

Attachment mechanism 164 may further include a release mechanism 168. Release mechanism 168 is adapted to immediately release attachment mechanism 164 from straps 140 during the lifting process in case of an emergency. For example, if during the lifting process the patient 50 has collapsed or is threatening to pull the user down, the user may actuate release mechanism 168 in order to uncouple attachment mechanism 164 from the user, and thereby release straps 140 during the lifting process. In an exemplary embodiment, release mechanism 168 comprises a toggle on the exterior of attachment mechanism 164, as shown in FIG. 5. The toggle may be configured to release a ratcheting mechanism within attachment mechanism 164, allowing the tether to extend to compensate for the movement of patient 50.

Figure 6:
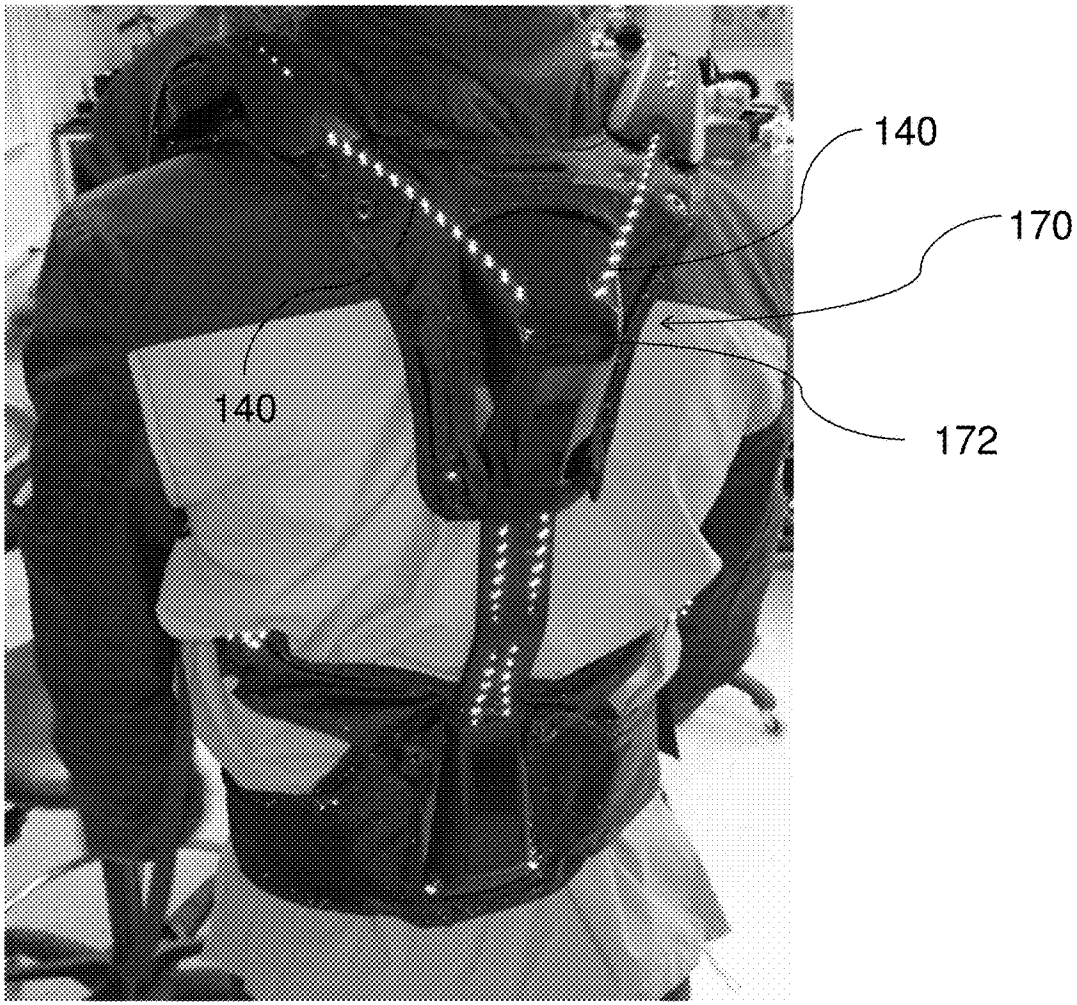
FIG. 6 is an image showing an exemplary retraction device of the medical lifting device illustrated in FIG. 1.

Device 100 may further include a retraction device 170, as shown in FIG. 6. Retraction device 170 can be coupled to brace 120 such that it retracts straps 140 when they are not in use. In particular, retraction device 170 is configured to retract straps 140 from a first use position to a second standby position. Preferably, retraction device 170 automatically retracts straps 140 when medical lifting device 100 is not in use.

In an exemplary embodiment, retraction device 170 comprises one or more elastic members 172 that are coupled to straps 140. The elastic members 172 may be separate elastic elements (such as linear or torsion springs). In a particular preferred embodiment, elastic members 172 comprises torsion springs coupled to both straps 140, as shown in FIG. 6. The torsion springs are mounted along a plane substantially orthogonal to the plane of brace 120, in order to provide a desired retracting force on straps 140. Alternatively or additionally, straps 140 may be formed at least in part from an elastic material that comprises the retraction device 170. In either form, the elastic members operate to automatically retract straps 140 when force is not being applied during use of device 100.

Retraction device 170 may also comprise one or more pulleys coupled to brace 120. In this embodiment, straps 140 run along pulleys. When straps 140 are not in use, the pulleys apply a force to straps 140 that cause them to retract into the standby position.

Figure 7:
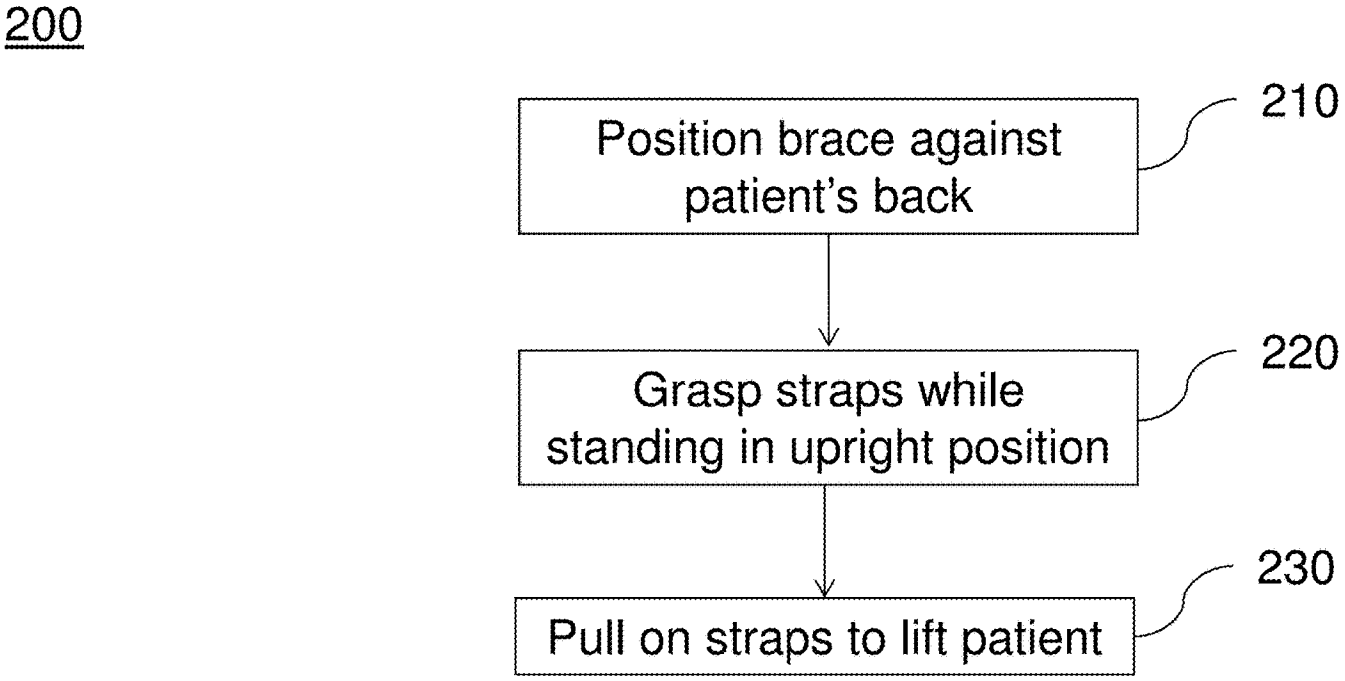
FIG. 7 is a flowchart illustrating an exemplary method for lifting a patient in accordance with aspects of the present invention.

FIG. 7 illustrates an exemplary method for lifting a patient 200 in accordance with aspects of the present invention. Method 200 may be performed by a healthcare worker. As a general overview, method 200 includes positioning a brace on a subject or patient, grasping the straps, and pulling on the straps. The steps of method 200 are described in detail below with respect to the components of medical lifting device 100.

In step 210, a brace is positioned against the back of a patient. In an exemplary embodiment, brace 120 is positioned against the back of patient 50. Brace 120 has a pair of opposed lateral edges 126, and a strap 140 extending from each lateral edge. As set forth above, brace 120 is desirably shaped such that is provides support to the optimal region of the lower back of patient 50 during lifting.

In step 220, each strap is grasped by a user. The user may be standing or in an upright position. In an exemplary embodiment, straps 140 are sufficiently long that a user standing in an upright position is able to grasp each strap 140 while patient 50 is in a seated position.

In step 230, each strap is pulled by a user to lift the patient to a standing position. In one embodiment, the user pulls on straps 140, thereby applying a lifting force to the back of patient 50 via brace 120, and lifting the patient 50 into a standing position. By positioning brace 120 against the lower back of patient 50, brace 120 desirably provides an upward, lifting force when pulled with straps 140. To this end, as set forth above, straps 140 extend outward from brace 120 in the regions of the top and bottom edges 122 and 124 of brace 120.

Method 200 is not limited to the foregoing steps, but may include alternative or additional steps, as would be understood by one of ordinary skill in the art from the description herein.

As set forth above, device 100 may include a pair of handle portions 150. In this embodiment, method 200 may include the step of enabling the patient to grasp a handle portion coupled to each strap. In an exemplary embodiment, patient 50 is enabled to grasp each handle portion 150 during the lifting process. This provides the patient with a location to place their hands during the lifting process. This might give the patient the feeling that he or she is assisting with the lifting process, and thereby exerting some control in the lifting process.

Device 100 may also include one or more attachment mechanisms 160. In this embodiment, method 200 may include the step of attaching each strap to the user. In an exemplary embodiment, straps 140 are attached to a belt worn by the user via one or more attachment mechanisms 160. These attachment mechanisms 160 bear at least a portion of the weight of patient 50 when coupled to the user during the lifting process. Where attachment mechanisms 160 further include a release mechanism 164, method 200 may further include the step of immediately releasing each strap from the user during lifting. In an exemplary embodiment, the user may actuate release mechanism 164 in order to immediately release straps 140 should an emergency arise during the lifting process.

Device 100 may also include a retraction device 170. In this embodiment, method 200 may include the step of retracting each strap from a first use position to a second standby position. In an exemplary embodiment, each strap 140 is retracted by retraction device 170 from a first use position (i.e., extended) to a second, standby position (i.e., retracted). Desirably, retraction device 170 is operable to automatically retract straps 140 to the standby position when straps 140 are not being grasped and/or pulled on by the user.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A medical lifting device comprising:

a brace adapted to be positioned against the back of a patient, the brace having a pair of opposed lateral edges, the brace including a rigid core configured to rigidly support the back of the patient and a padding layer positioned such so as to be between the rigid core and the back of the patient when the brace is positioned against the back of the patient;

at least one strap extending from each lateral edge of the brace, the at least one strap having a length sufficient to enable a user of the device to grasp each strap while the user is standing with the user's torso in an upright position and the patient is in a seated position, the at least one strap including first and second handle portions, the first handle portion being configured to be positioned between the user's torso and the patient and to be grasped by the user during lifting, the second handle portion being configured to be positioned between the user's torso and the patient and to be grasped by the patient during lifting.

2. The medical lifting device of claim 1, wherein the at least one strap has a length of at least 17 to 29 inches from each lateral edge of the brace to a distal portion of the at least one strap.

3. The medical lifting device of claim 1, wherein each handle portion comprises a material that is more rigid than a material of each strap.

4. The medical lifting device of claim 1, wherein the position of each handle portion relative to the at least one strap is adjustable along the length of the at least one strap.

5. The medical lifting device of claim 1, wherein each handle portion extends approximately orthogonally relative to a direction along the length of each strap.

6. The medical lifting device of claim 1, wherein the at least one strap comprises one or more attachment mechanisms configured to be coupled to the user, the one or more attachment mechanisms bearing at least a portion of the weight of the patient during lifting when coupled to the user.

7. The medical lifting device of claim 6, wherein the one or more attachment mechanisms are configured to be attached to a belt worn by the user.

8. The medical lifting device of claim 6, wherein the one or more attachment mechanisms comprise a release mechanism, the release mechanism adapted to immediately release the at least one strap from the user during lifting.

9. The medical lifting device of claim 1, wherein the brace is shaped such that when the brace is positioned against the back of the patient, a top edge of the brace extends across a lower thoracic region of the back of the patient, and a bottom edge of the brace extends across a lower lumbar region of the back of the patient.

10. The medical lifting device of claim 1, wherein the at least one strap comprises a first strap portion coupled to the lateral edge of the brace and positioned such that, when the medical lifting device is in use, the first strap portion is configured to be positioned adjacent a lower thoracic region of the back of the patient, and a second strap portion coupled to the lateral edge of the brace and positioned such that, when the medical lifting device is in use, the second strap portion is configured to be positioned adjacent a lower lumbar region of the back of the patient.

11. The medical lifting device of claim 1, further comprising a retraction device coupled to the brace, the retraction device configured to retract the at least one strap from a first use position to a second standby position.

12. The medical lifting device of claim 11, wherein the retraction device automatically retracts the at least one strap to the second standby position when the lifting device is not in use.

13. The medical lifting device of claim 11, wherein the retraction device comprises one or more elastic members coupled to the at least one strap.

14. The medical lifting device of claim 13, wherein the one or more elastic members form part of the at least one strap.

15. The medical lifting device of claim 11, wherein the retraction device comprises one or more pulleys coupled to the brace, the at least one strap running along the one or more pulleys.

16. A method of lifting a patient by a user comprising:

positioning a brace against the back of a patient, the brace having a pair of opposed lateral edges and a strap extending from each lateral edge of the brace, wherein the brace includes a rigid core configured to rigidly support the back of the patient and a padding layer positioned such so as to be between the rigid core and the back of the patient when the brace is positioned against the back of the patient, and wherein each strap includes first and second handle portions, the first handle portion being configured to be positioned between the user's torso and the patient and to be grasped by the user during lifting, the second handle portion being configured to be positioned between the user's torso and the patient and to be grasped by the patient during lifting;

grasping each strap while standing in an upright position and while the patient is in a seated position, and pulling on each strap to lift the patient to a standing position.

17. The method of claim 16, further comprising the step of:

enabling the patient to grasp a handle portion coupled to each strap.

18. The method of claim 16, further comprising the step of:

attaching each strap to the user via one or more attachment mechanisms on the strap.

19. The method of claim 18, wherein the attaching step comprises attaching each strap to a belt worn by the user.

20. The method of claim 18, further comprising the step of:

immediately releasing each strap from the user during lifting using a release mechanism.

21. The method of claim 16, further comprising the step of:

retracting each strap from a first use position to a second standby position using a retraction device.

22. The method of claim 21, wherein the retracting step comprises automatically retracting each strap to the second standby position when the strap is not grasped.

* * * * *